US011547251B2

(12) United States Patent
McCarthy et al.

(10) Patent No.: US 11,547,251 B2
(45) Date of Patent: Jan. 10, 2023

(54) ADAPTIVE TOWELETTE DISPENSER

(71) Applicants: Melanie H. McCarthy, Huntington Beach, CA (US); Steve Wild, Huntington Beach, CA (US); Jon E Stevenson, Huntington Beach, CA (US)

(72) Inventors: Melanie H. McCarthy, Huntington Beach, CA (US); Steve Wild, Huntington Beach, CA (US); Jon E Stevenson, Huntington Beach, CA (US)

( * ) Notice: Subject to any disclaimer, the term of this patent is extended or adjusted under 35 U.S.C. 154(b) by 32 days.

(21) Appl. No.: 17/169,102

(22) Filed: Feb. 5, 2021

(65) Prior Publication Data

US 2021/0153700 A1 May 27, 2021

Related U.S. Application Data

(63) Continuation of application No. 16/044,354, filed on Jul. 24, 2018, now abandoned.

(Continued)

(51) Int. Cl.
*A47K 10/36* (2006.01)
*A47K 10/26* (2006.01)

(Continued)

(52) U.S. Cl.
CPC ..... *A47K 10/3625* (2013.01); *A47K 10/26* (2013.01); *A47K 10/16* (2013.01);

(Continued)

(58) Field of Classification Search
CPC .... A47K 10/3625; A47K 10/26; A47K 10/16; A47K 2010/3273; A47K 210/328; A47K 2010/3293

(Continued)

(56) References Cited

U.S. PATENT DOCUMENTS 724,187 A 3/1903 Joyce
2,789,725 A * 4/1957 Carper ..... A47K 10/427 221/56

(Continued)

FOREIGN PATENT DOCUMENTS

CN 200820126728 6/2008
CN 201234946 Y * 5/2009 ..... A61J 7/0084

(Continued)

OTHER PUBLICATIONS

International Search Report dated Oct. 29, 2018, for related PCT application No. PCT/US2018/043552, filed on Jul. 24, 2018. 12 pages.

(Continued)

*Primary Examiner* — Rakesh Kumar
(74) *Attorney, Agent, or Firm* — Fish IP Law, LLP

(57) ABSTRACT

An adaptive towelette dispensing device is provided. The device is operable in conjunction with a container storing a plurality of dried, compressed, individually wrapped, preferably sealed towelettes. The adaptive towelette dispensing device is contemplated to include one or more reservoirs adapted to receive additives, one or more pumps configured to transfer additives through a conduit to be incorporated into a dispensed solution. The adaptive towelette dispensing device is further contemplated to include a towelette releasing mechanism, a towelette chute, a towelette dispensing mechanism, and a controller.

7 Claims, 12 Drawing Sheets

Related U.S. Application Data

(60) Provisional application No. 62/536,922, filed on Jul. 25, 2017.

(51) Int. Cl.
*A47K 10/32* (2006.01)
*A47K 10/16* (2006.01)

(52) U.S. Cl.
CPC ..... *A47K 2010/328* (2013.01); *A47K 2010/3273* (2013.01); *A47K 2010/3293* (2013.01)

(58) Field of Classification Search
USPC ..... 222/192, 321.7, 383.1, 129, 166, 183, 222/190; 221/96, 102; 206/233, 38
See application file for complete search history.

(56) References Cited

U.S. PATENT DOCUMENTS 3,189,228 A * 6/1965 Steinbart ..... A61F 15/001 222/215
3,865,271 A 2/1975 Gold
3,947,134 A * 3/1976 Ogawa ..... A47K 10/32 219/214
3,976,208 A * 8/1976 Buix ..... A23L 3/001 414/928
3,980,203 A * 9/1976 Dearling ..... A47K 10/42 239/289
4,069,789 A * 1/1978 Fukagawa ..... B65H 35/0046 118/43
4,543,913 A * 10/1985 Wilkeson ..... A01K 13/003 401/28
4,598,664 A * 7/1986 Hamlin ..... A47K 10/32 118/325
4,667,846 A * 5/1987 Marceau ..... A47K 10/32 221/96
4,759,652 A * 7/1988 Ulrich ..... A45D 34/00 206/226
5,044,556 A 9/1991 Suzuki
5,312,021 A * 5/1994 Nelson ..... A47K 10/32 239/289
5,439,104 A * 8/1995 Wolska-Klis ..... G02C 13/006 221/96
5,609,268 A * 3/1997 Shaw ..... A61J 7/0481 221/82
5,697,577 A 12/1997 Ogden
5,887,759 A * 3/1999 Ayigbe ..... A47K 10/32 118/325
6,021,919 A * 2/2000 Kelly ..... A61B 42/40 221/281
6,213,424 B1 * 4/2001 Helfer-Grand ..... A47K 10/34 242/563
6,319,318 B1 11/2001 Pekarek
6,321,937 B1 * 11/2001 DeSimone ..... A47K 10/3818 221/45
6,457,434 B1 10/2002 Lazar
6,601,730 B2 8/2003 Chen
6,613,144 B1 * 9/2003 Loertscher ..... A47K 10/32 118/325
6,668,843 B2 12/2003 Chen
6,698,425 B1 * 3/2004 Widerstrom ..... A61M 15/0036 128/203.15
6,779,682 B2 8/2004 Chen
6,789,695 B1 * 9/2004 Gaudreau ..... E05B 1/0069 221/102
6,962,266 B2 11/2005 Morgan
7,018,473 B2 * 3/2006 Shadrach, III ..... A47K 10/3818 118/316
7,320,418 B2 1/2008 Sassoon
7,370,754 B2 * 5/2008 Kushner ..... B08B 1/006 206/233
7,497,351 B2 * 3/2009 Amundson ..... A47K 10/421 221/96
8,087,543 B2 * 1/2012 Yang ..... A47K 5/1217 222/642
8,365,507 B2 * 2/2013 Klingel ..... B65B 69/0058 53/472
9,227,830 B2 * 1/2016 Angus ..... B65B 7/28
9,603,495 B2 3/2017 Manfredonia
10,064,525 B2 9/2018 Ader
2001/0006206 A1 * 7/2001 Helfer-Grand ..... A47K 10/485 242/598.6
2002/0148491 A1 * 10/2002 Chen ..... A47K 10/32 134/42
2002/0148848 A1 * 10/2002 Chen ..... A47K 10/32 206/391
2002/0187276 A1 12/2002 Zhang
2004/0129716 A1 7/2004 Naufel
2004/0200410 A1 * 10/2004 Shadrach, III ..... A47K 10/3818 118/400
2008/0035520 A1 * 2/2008 Caracciolo ..... G07F 17/0092 206/535
2008/0135570 A1 6/2008 Lee
2008/0257906 A1 * 10/2008 Orgna ..... A47K 5/1202 221/303
2009/0032553 A1 * 2/2009 Eddy ..... A61L 9/14 222/183
2009/0090737 A1 * 4/2009 Franco ..... A47K 5/12 221/96
2012/0006848 A1 * 1/2012 Reynolds ..... G01F 13/00 222/63
2013/0126549 A1 * 5/2013 Ader ..... A47K 7/03 221/96
2013/0282163 A1 * 10/2013 Brown ..... B65D 83/0463 700/215
2015/0245747 A1 * 9/2015 Manfredonia ..... A47K 10/426 221/96
2015/0272404 A1 10/2015 Jeon
2016/0114301 A1 * 4/2016 Jablonski ..... B67D 1/12 366/141
2019/0029476 A1 * 1/2019 McCarthy ..... A47K 10/26

FOREIGN PATENT DOCUMENTS

JP 20050022356 A * 3/2005 ..... A47K 7/00
KR 20050022356 A * 3/2005 ..... A47K 7/00
KR 1020050022356 3/2005
WO 2007066865 6/2007
WO WO-2007066865 A1 * 6/2007 ..... A47K 10/32
WO WO-2011023941 A2 * 3/2011 ..... A61J 7/0084

OTHER PUBLICATIONS

PCT Search Report & Written Opinion dated Oct. 29, 2018 for PCT/US2018/043552 filed on Jul. 24, 2018 in the name of Melanie McCarthy et al.

* cited by examiner

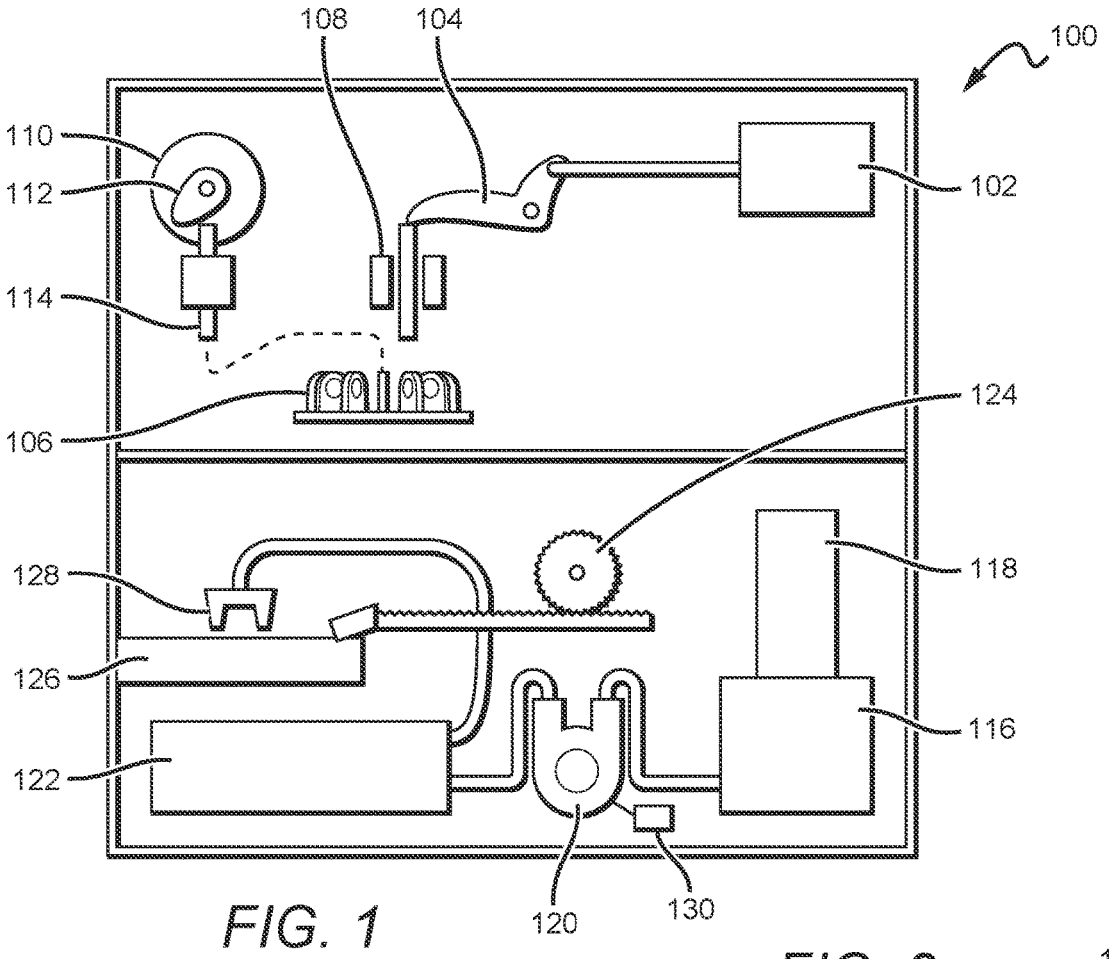
FIG. 1
FIG. 2
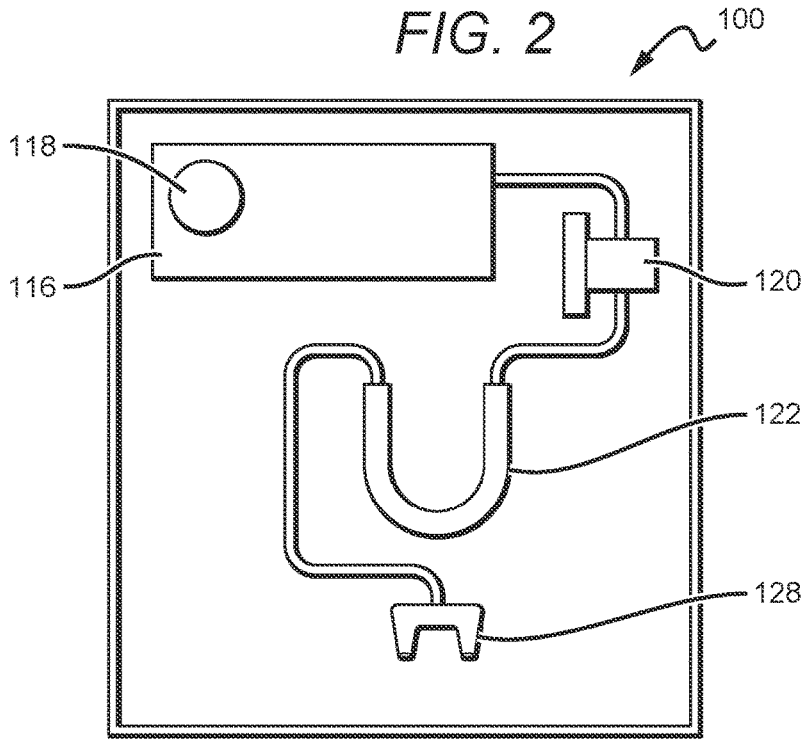

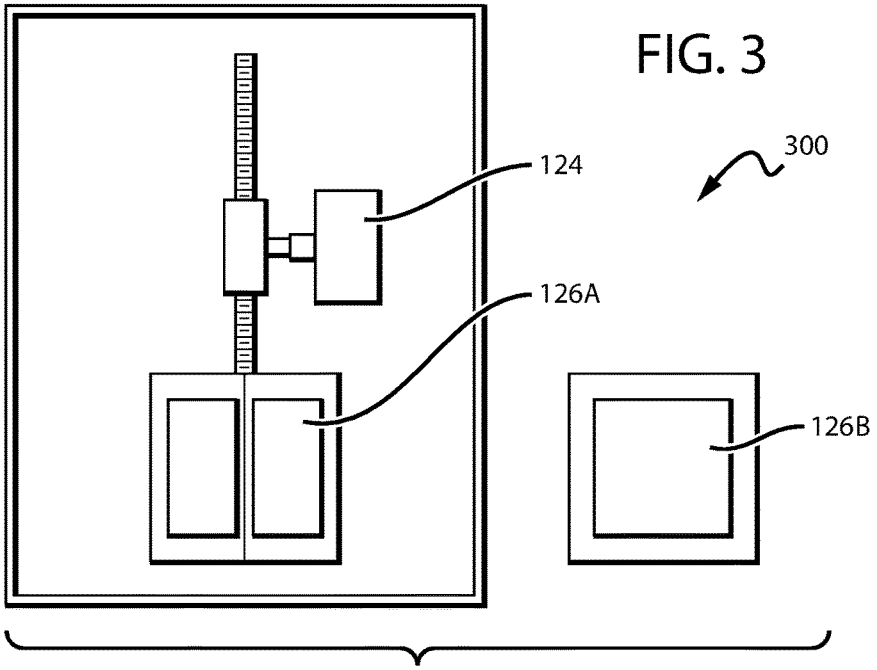
FIG. 3
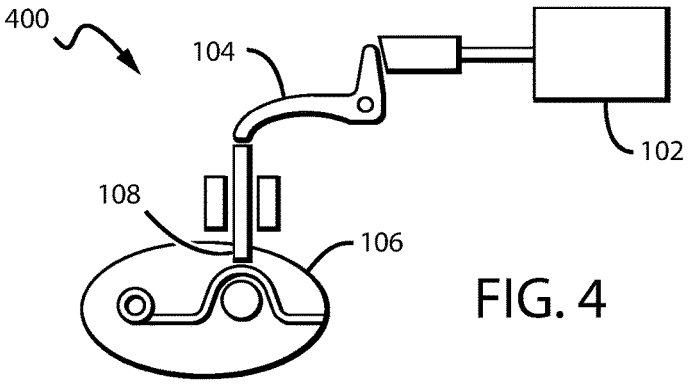
FIG. 4
FIG. 5
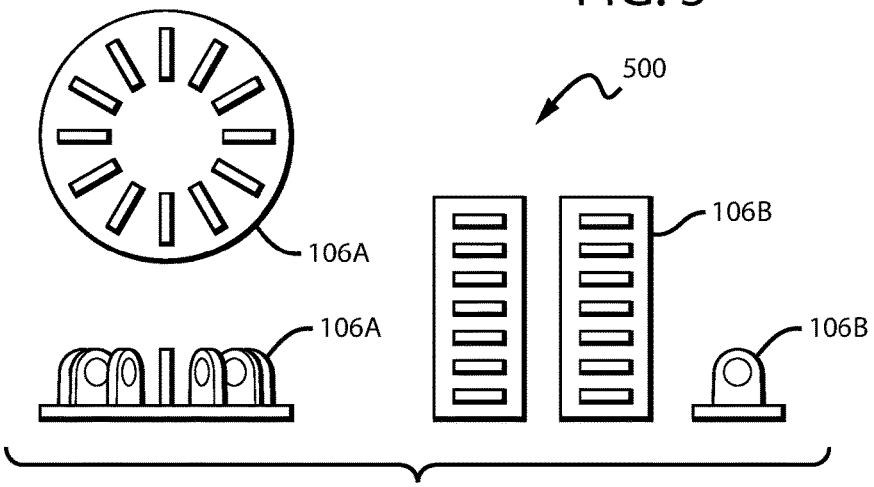

ADAPTIVE TOWELETTE DISPENSER

This application is a continuation-in-part of and claims the benefit of U.S. patent application Ser. No. 16/044,354, titled "DEVICE FOR DISPENSING STERILE ON DEMAND, HEATED TOWELETTES", filed on Jul. 24, 2018. U.S. patent application Ser. No. 16/044,354 claims priority to U.S. Provisional Application No. 62/536,922, filed Jul. 25, 2017. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is systems, devices, and methods for generating sterile, heated towelettes on demand.

BACKGROUND

The background description includes information that may be useful in understanding the present invention. It is not an admission that any of the information provided herein is prior art or relevant to the presently claimed invention, or that any publication specifically or implicitly referenced is prior art.

Disposable wet tissues or towelettes are commonly used for many personal hygiene purposes, including baby towelettes, and disposable wet hand towels distributed in the restaurants or other public places (e.g., in the airplane, hospital, etc.). Virtually all commercially available wet tissues or towelettes are pre-soaked with liquid (e.g., water, water with isopropyl alcohol, etc.), and may also be treated with softeners, lotions, or scent materials, depending on the purpose. While convenient in use, wet tissues or towelettes are susceptible to contaminations by microorganisms (e.g., fungus, bacteria, etc.) due to the wet environment. Thus, in many cases, in order to prevent such fungal or bacterial contaminations, wet tissues or towelettes are further treated with some preservatives (e.g., methylisothiazolinone, etc.), which can sometimes provoke allergic reaction in users.

There have been efforts to solve these problems using a compact, dry towelette, which can be expanded and wetted through addition of a little amount of water. While compact, dry towelettes solve the contamination issues, they inconveniently require a user need to supply water to wet the towelettes. Also, while it only requires several milliliters of water to fully expand and wet the tissue, it is often hard for a user to pour that small amount of water over the towelettes, resulting in overspilling the water.

The prior art includes dispensing apparatus that add a small, predetermined amount of water to expand and wet for compact, dry towelettes. For example, U.S. Pat. No. 6,601,730 to Chen discloses a wet towel dispensing apparatus. In this apparatus, individually strapped dry, compressed towels are serially drawn out, and then be soaked with either cold or hot water. In another example, International Patent Application No. WO 2007/066865 to Kim discloses a coin tissue (compressed tissue) dispenser accompanied with water sprayer that can expand the dry tissue into an expanded wet towel. In Kim's device, multiple coin tissues are loaded in a coin case in the dispenser. Similarly, U.S. Patent Application No. US 2013/0126549A1 to Ader discloses a coin tissue dispenser that is coupled with water compartment.

The chamber receives the dry compressed towels and the liquid. A trigger mechanism provides for selectively introducing both (a) at least one dry compressed towels and (b) wetting liquid into the chamber. Actuation of the trigger mechanism causes the dry compressed towel to enter the chamber and to be exposed the liquid.

However, all of above dispensers cannot utilize individually wrapped, compressed towelettes, and end up storing unwrapped towelettes in the device, which of course are not sterile.

Thus, there is still a market need for a device that automatically dispenses wetted towelettes, which had been stored in the device in a sterile fashion.

SUMMARY OF THE INVENTION

The inventive subject matter provides systems, devices for automatically dispensing wetted towelettes, which have been stored in the device in a sterile fashion.

The present invention contemplates the use of a towelette dispensing device operable in conjunction with a container storing a plurality of dried, compressed, individually wrapped towelettes. The device comprises a pump configured to transfer a predetermined amount of liquid from a liquid reservoir to a heat exchanger to heat the liquid to a predetermined temperature. However, it is also contemplated that the liquid can also be cooled to any temperature. Allowing the temperature of the liquid to be controlled advantageously allows the towelette dispenser to be used for a wide variety of applications. For example, a heated liquid can be used to match the body temperature of a patient, and a cooled liquid can be used for a towelette meant to sterilize a burn.

The device further comprises a plunger configured to release a first one of the towelettes from its individual wrapping. It is contemplated that the individual wrapping can be selected from a plurality of containers. Preferred implementations include a blister pack can be used to prevent towelettes from contamination. However, the present invention contemplates the use of any containing mechanism that preserves the sterility of the towelettes.

After producing a wetted towelette, the towelette dispenser delivers the sterile, wetted towelette to a user. In preferred embodiments, the towelette dispenser dispense the wetted towelette using a retractable tray. However, the use of any mechanism or combination of mechanism that advantageously minimizes exposure of the internal component of the device to the outside environment is contemplated.

Various objects, features, aspects and advantages of the inventive subject matter will become more apparent from the following detailed description of preferred embodiments, along with the accompanying drawings in which like numerals represent like components.

BRIEF DESCRIPTION OF THE DRAWINGS

FIG. 1 is a cross-sectional view of the dispenser according to an embodiment of the inventive subject matter.

FIG. 2 is a top-down perspective view of the liquid dispensing portion of the dispenser according to an embodiment of the inventive subject matter.

FIG. 3 is a top-down perspective view of a tray mechanism of the dispenser according to an embodiment of the inventive subject matter.

FIG. 4 is a side view of a sterile towelette dispensing mechanism of the dispenser according to one embodiment of the inventive subject matter.

FIG. 5 is a top-down and a side perspective view of a disk blister pack and a linear blister pack.

DETAILED DESCRIPTION

Figure 6:
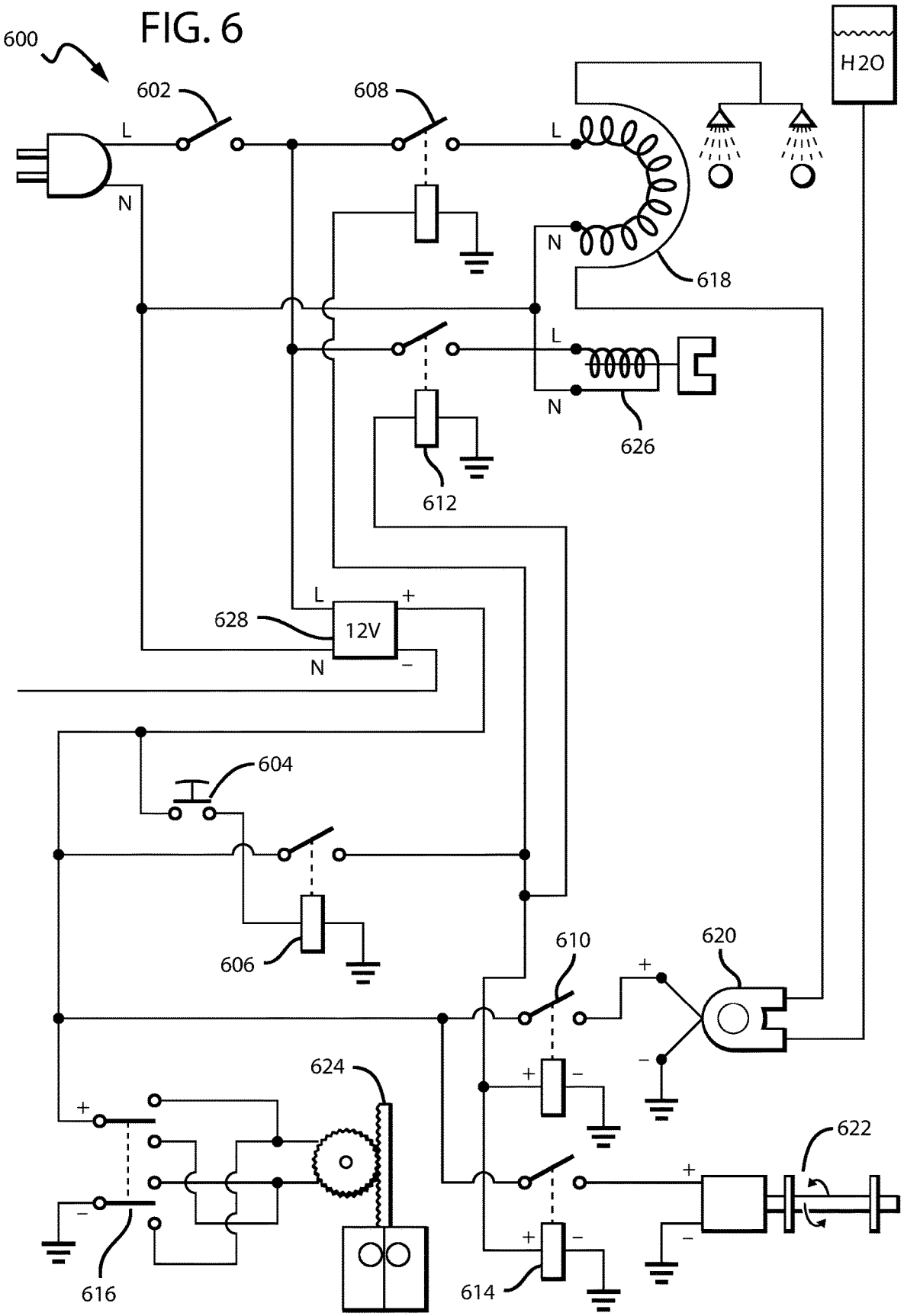
FIG. 6 depicts an exemplary embodiment of the electrical, mechanical circuit of the device.

Various objects, features, aspects and advantages of the inventive subject matter will become more apparent from the following detailed description of preferred embodiments, along with the accompanying drawing figures in which like numerals represent like components.

While the inventive subject matter is susceptible of various modification and alternative embodiments, certain illustrated embodiments thereof are shown in the drawings and will be described below in detail. It should be understood, however, that there is no intention to limit the invention to the specific form disclosed, but on the contrary, the invention is to cover all modifications, alternative embodiments, and equivalents falling within the scope of the claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 is a cross-sectional side view of the dispenser according to an embodiment of the inventive subject matter.

Dispenser 100 comprises a dry dispensing portion and a wet dispensing portion. The dry dispensing portion can comprise solenoid 102, angle changer 104, plunger 108, cam motor 110, cam 112, and cam plunger 114.

Solenoid 102 can comprise any solenoid mechanism using a coiled wire as an electromagnet. However, solenoid 102 can comprise any mechanism that creates a directional force upon triggering and causes the movement of a plunger. For example, solenoid 102 can be any alternative electromechanical switch, including, for example, relays and contactors. In other embodiments, solenoid 102 can be a purely mechanical mechanism designed to transmit directional force. For example, solenoid 102 can be a simple mechanical button that engages angle changer 104.

Angle changer 104 can comprise any mechanism or combination of mechanisms that changes the direction of the force resulting from triggering solenoid 102. Mechanisms associated with angle changer 104 include, but are not limited to, sliding mechanisms, pivoting mechanisms, and electro-mechanical mechanisms. However, it is contemplated that, in embodiments where the direction of force does not need to be changed, dispenser 100 does not include angle changer 104. In the depicted embodiment, angle changer 104 is a substantially L-shaped member that pivots around an axis.

Plunger 108 engages angle changer 104 such that the directional force applied by angle changer 104 on plunger 108 is transferred to towelette storage 106. It is contemplated that plunger 108 transfers sufficient force in a direction that causes a single blister pack containing a sterile towelette to release its content. The content can include any variety of sterilized towelettes, including, for example, compressed towelettes, pre-moistened towelettes, and uncompressed towelettes.

Alternatively or additionally, dispenser 100 can comprise cam motor 110, cam 112, and cam plunger 114. Cam motor 110 is coupled to cam 112 such that operating cam motor 110 causes a reciprocating motion of cam plunger 114. It is contemplated that any type of reciprocating engine can be used to cause cam plunger 114 to engage a blister pack of towelette storage 106 to cause a sterile towelette to be dispensed.

It is also contemplated that any combination of one or more mechanisms that engage plunger 108 and/or cam plunger 114 can be used to dispense a dried, compressed towelette and push empty packages into a disposal container.

Towelette storage 106 is not limited to the embodiment depicted, and can be any means of storing a plurality of dried, compressed, individually wrapped towelettes in the device. Preferably, the dried, compressed towelettes can be any commercially available dried, compressed towelettes in any shapes (e.g., a coin shape, a square shape, etc.) and/or in any sizes.

In some embodiments, towelette storage 106 can comprise single sized, single shaped, dried, compressed towelettes stored in a disk-shaped blister pack. In other embodiments, towelette storage 106 can comprise single sized, single shaped, dried, compressed towelettes stored in a linear blister pack. It is contemplated, however, that towelette storage 106 can be any means of storing dried, compressed towelettes in multiple sizes and/or in different shapes.

In some embodiments, towelette storage 106 comprises a column that stores the dried, compressed towelettes. In these embodiments, when one or more dried, compressed towelettes are dispensed from the bottom of the column at a time, dried, compressed towelettes stacked above the dispenses towelette move down toward the bottom of the column. The column can be in any desired size or shape to store the dried, compressed towelettes. In some embodiments, the column is sized and dimensioned to store two or more dried, compressed towelettes in a row so that multiple dried, compressed towelette can be dispensed at a time.

It is also contemplated that towelette storage 106 can comprise a turntable or a spinner having multiple slots, in which each of the slots is sized and dimensioned to contain one or more dried, compressed towelettes. In these embodiments, when one or more dried, compressed towelettes are dispensed from one slot, the turntable rotates so that the dried, compressed towelettes of the neighboring slot can be dispensed next time. In some embodiments, the turntable can rotate in one direction only (e.g., clockwise, counter-clockwise). However, it is also contemplated that the turntable can rotate in both directions.

In one specific embodiment, the inventors contemplate that when the device is on, solenoid 102 engages a cam assembly, including cam motor 110 and cam 112, that pushes cam plunger 114 using a sprung guillotine plunging mechanism in a linear direction and with force sufficient to dispense two dried, compressed towelettes from the top through the bottom of a column (blister pack cartridge) into a retractable dispensing tray. Cam motor 110 engages cam 112 (depicted as a rotating Scotch yolk cam) that is mounted to cam motor 110, and attached by a low-profile mounted ball bearing with a shaft diameter dimensioned appropriately for dispenser 100. It is contemplated that dispenser 100 can comprise retractable L-handle spring plungers that have adjustable plastic tips to compress a spring activated ratchet and advance the blister pack cartridge to the next stage in embodiments using a blister pack cartridge.

In some embodiments, dispenser 100 is configured to dispense only one dried, compressed towelette at a time. In other embodiments, dispenser 100 can dispense two or more dried, compressed towelettes at a time automatically or upon user's selection. In these embodiments, it is preferred that two dried, compressed towelettes are non-overlapped on tray 126.

Preferably, the dried, compressed towelettes are individually wrapped and/or sealed in a package (e.g., plastic package, etc.), such that the dried, compressed towelettes are kept unexposed to dust, mold, fungus, bacteria, thus sterile. Thus, the inventors contemplate that the dried, individually wrapped compressed towelettes can remain unwrapped until they are dispensed from towelette storage 106.

In some embodiments, towelette storage 106 is coupled with a cutting mechanism (e.g., blade, etc.) and/or plunger 108. It is preferred that the cutting mechanism is placed where the dried, compressed towelettes is dispensed (e.g., around the edge of the bottom of the column container or the slot of the spinner, around the edge of the dispensing opening of the column container, etc.).

Alternatively or additionally, plunger 108 pushes the dried, compressed towelettes against the cutting mechanism so that the dried, compressed towelettes are separated out of the package and dispensed to a tray below the container. It is preferred that the cutting mechanism is sized and dimensioned to contact less than 90%, preferably less than 80% of the perimeter of the packaging such that the cut portion of the packaging is not dispensed with the dried, compressed towelettes.

It is contemplated that once the dried, compressed towelette is dispensed to tray 126 by pushing by plunger 108, plunger 108 can further push away the empty package separated from the dried, compressed towelettes to a separate disposing container for empty packages. For example, if towelette storage 106 is a column containing dried, compressed towelettes, then the column can move laterally above a disposing container after dispensing the dried, compressed towelette is dispensed, and the plunger can further push away the package to the disposing container. Following disposal of the empty packaging, it is contemplated that the column can move back to the original position (e.g., above the tray, etc.).

In another example, if towelette storage 106 is a spinner or a turntable, the spinner can rotate in a predetermined angle so that the empty package without the dried, compressed towelette can be placed above the disposing container. Plunger 108 can then further push away the empty package into the disposing container. While the same plunger can be used to dispense the dried, compressed towelette and push away the empty package, it is also contemplated that the device includes two plungers: one for dispensing the dried, compressed towelette, and another for pushing away the empty package.

In other embodiments, once the dried, compressed towelette is dispensed to tray 126 from the column by pushing by the plunger, the empty packaging may remain in the bottom of the column. In these embodiments, next wrapped dried, compressed towelette can be dispensed through the old empty package left in the bottom of the column. In this scenario, it is preferred that the empty packages stacked in the bottom of the column can be manually removed or pushed by the plunger when a user wishes to remove all empty packages from dispenser 100.

The wet dispensing portion of dispenser 100 can comprise reservoir 116, reservoir filling mechanism 118, pump 120, heating element 122, serving tray 126, and spray nozzles 128.

Once the unwrapped dried, compressed towelette is dispensed into tray 126, the dried, compressed towelette is treated with one or more liquids so that the dried, compressed towelette is expanded and wet. As used herein, "wetting" means adding sufficient liquid to at least moisten the item being wetted. Most typically, the liquid is water. However, it is contemplated that the liquid can be water mixed with any other desired chemicals (e.g., ethanol, disinfectant, sanitizing reagent, degreasers, perfume, etc.).

Reservoir 116 can contain a liquid to be administered to the dried, compressed towelette. It is contemplated that reservoir 116 is contained within dispenser 100. However, reservoir 116 can be operatively coupled to dispenser 100 without being contained with the body of dispenser 100. In embodiments where reservoir 116 is contained within the body of dispenser 100, reservoir 116 can be operatively coupled to reservoir filling mechanism 118. For example, reservoir filling mechanism 118 can be a fill tube connected to reservoir 116 at a first end and comprises a removable cover at the second end to receive one or more liquids for transfer into reservoir 116.

While virtually any temperature liquid can be used to expand and wet the dried, compressed towelette, it is often preferred that the liquid is in a temperature range higher than the room temperature (e.g., between 70-80° C., between 50-70° C., between 30-50° C.), or lower than the room temperature (e.g., between 5-15° C., between 10-20° C., etc.), depending on the purpose of use. Thus, it is especially preferred that the wet towelette dispensing device can include temperature control 122 (heater, cooler or heat exchanger) to either heat the liquid or cool the liquid to a desired temperature (e.g., at least 150° F., preferably 165° F. for heated towelettes, between 50-60° F., between 40-50° F. for cooled towelettes, etc.), and pump 120 that is configured to transfer a predetermined amount of liquid (e.g., between 1-3 ml, between 3-5 ml, between 5-10 ml, between 10-20 ml, etc.) from a liquid reservoir to the heat manager.

Preferably, pump 120 is a hydrostatic pump. However, it is contemplated that any commercially available pump can be used. For example, pump 120 can be selected from one or more of a plunger-based pump, a piston-based pump, a circumferential-piston pump, a diaphragm pump, a bellows pump, gear pumps, lobed pumps, flexible-vane pumps, nutating pumps, peristaltic pumps, centrifugal pumps, and mixed-flow pumps.

In some embodiments, pump 120 is coupled with a sensor 130 that is configured to detect at least one of the weight of the dried, compressed towelettes to be dispensed, number of the dried, compressed towelettes in a container, and degree of dryness of the towelettes. In other aspects, pump 120 is coupled with a select switch, which allows a user to select at least one of weight of the dried, compressed towelette, number of the dried, compressed towelettes, and dryness of the dried, compressed towelette.

Based on the information obtained from the sensor or user's operation of the select switch, pump 120 can be configured to transfer an amount of liquid enough to expand and wet the dried, compressed towelettes. For example, the sensor can be a camera that can detects the number of dried, compressed towelettes. If the number of the dried, compressed towelettes is two, the sensor can send the information to pump 120 so that it can transfer at least twice more liquid to the heat exchanger than the liquid amount enough to expand one dried, compressed towelette.

The cooled or heated liquid at temperature control 122 is dispensed to the dried, compressed towelettes on the tray via one or more spray nozzles coupled to the heat exchanger. It is expected that the dried, compressed towelettes absorb liquids and expands within 15 seconds, preferably within 10 seconds and would be ready to be picked up by the user. However, it is contemplated that the dried, compressed towelettes can absorb liquids and expand in shorter or longer periods of time depending on the composition of the liquid and the composition of the dried, compressed towelettes.

In a preferred embodiment, tray 126 comprises a retractable slide that can be pushed out of the device when the moistened towelettes are ready to use (fully expanded and wet). It is also contemplated that tray 126 can be automatically retracted into the device for next service after the moistened towelette is picked up.

Alternatively, tray 126 can be automatically retracted after a predetermined time (e.g., 30 seconds, 60 seconds, etc.) after tray 126 is exposed out of the device. In other embodiments, tray 126 can be manually pushed into the device by the user.

It is also contemplated that tray 126 can be coupled to one or more sensors that allow dispenser 100 to detect that tray 126 either contains or does not contain a moistened towelette. For example, dispenser 100 may contain a weight sensor that detects when the moistened towelette has been lifted out of tray 126 by a user. In another example, dispenser 100 may contain a light sensor that detects when tray 126 opens to the outside environment and causes tray 126 to retract after a set period of time.

Alternatively, the tray is coupled with a plunging rod. The plunging rod extends outwardly from the device and moves the expanded wet towelettes toward an opening of the device from which a user can pick up the expanded wet towelettes. In this embodiment, the plunging rod retracts automatically once the expanded wet towelettes reaches to a predetermined area of the tray (e.g., 1 inch from the outer end of the tray, etc.).

Liquid dispenser 128 is operatively coupled to pump 120. In the depicted embodiment, liquid dispenser 128 is connected directly to temperature control 122 and indirectly to pump 120. In preferred embodiments, liquid dispenser 128 is a spray nozzle adapted to dispense liquid displaced by pump 120 onto a dried, compressed towelette. It is contemplated, however, that liquid dispenser 128 can be in any physical configuration and use any liquid dispensing mechanism known in the art. For example, liquid dispenser 128 can comprise any one or more of a drip-based mechanism, a liquid injection mechanism, and a tray-filling mechanism.

FIG. 2 is a top-down perspective view of the liquid dispensing portion of the dispenser according to an embodiment of the inventive subject matter. The liquid dispensing portion of the dispenser comprises reservoir 116, reservoir filling mechanism 118, pump 120, heating element 122, and liquid dispenser 128 all connected in a sequential order. However, it is contemplated that the depicted components can be combined in any way enabling liquid from reservoir 116 to be dispensed through liquid dispenser 128 onto a dried, compressed towelette.

FIG. 3 is a top-down perspective view of a tray mechanism 300 of the dispenser according to an embodiment of the inventive subject matter. Tray mechanism 300 comprises tray motor 124 and tray 126. In the depicted embodiment, tray 126 comprises two compartments to receive dried, compressed towelettes. Tray 126 is alternatively depicted as comprising one single compartment. Tray 126 can comprise any number of compartments adapted to receive any number of dried, compressed towelettes. For example, tray 126 can comprise one compartment adapted to receive multiple dried, compressed towelettes. In another example, tray 126 can comprise three compartments to receive three dried, compressed towelettes.

FIG. 4 is a side view of a sterile towelette dispensing mechanism 400 of the dispenser according to one embodiment of the inventive subject matter. Towelette dispensing mechanism 400 comprises solenoid 102, angle changer 104, plunger 108, and towelette storage 106. In alternative embodiments, angle changer 104 can be an optional component that is required only when the physical dimensions of dispenser 100 necessitate the use of angle changer 104.

FIG. 5 is a top-down and a side perspective view of two types of towelette storage 106. The illustrated embodiment depicts disk blister pack 106A and a linear blister pack 106B.

FIG. 6 depicts an exemplary embodiment of the electrical, mechanical circuit of the device. The exemplary sequence of the operations of the device of FIG. 6 is as below:

ON Button 602

Power to 12 Volt power supply and ON button

Power to heater relay

START Button 604

Momentary signal to cycle relay ~1 minute

CYCLE RELAY 606

Starts all other relays with 12 Volts D.C. for ~1 minute

HEATER RELAY 608

Supplies 120 Volt A.C. to heating element for ~30 seconds

PUMP RELAY 610

Supplies 12 Volt D.C. to hydrostolic pump for ~20 seconds

PLUNGER RELAY 612

Supplies 120 Volt A.C. to plunger solenoid for ~1 second

BUTTON RELAY 614

Supplies 12 Volts D.C. to cam motor for ~13 seconds

DRAWER OUT RELAY 616

Supplies 12 Volts D.C. to drawer motor

After heating cycle (~30 seconds)

Supplies 12 Volt D.C. to deploy drawer for ~3 seconds

DRAWER IN RELAY 616

Supplies 12 Volt D.C. to drawer motor to retract drawer for ~3 seconds from momentary SWI

HEATER 618

Heats water

Hyarulonic PUMP 620

Pumps measured amount of water that needs to be delivered to the spray nozzle upon operation.

CAM MOTOR 622

Rotates cam to rotate cartridge to next towelette

DRAWER MOTOR 624

Moves serving tray in and out

PLUNGER SOLINOID 626

Pushes towels out of cartridge into serving tray

Figure 7:
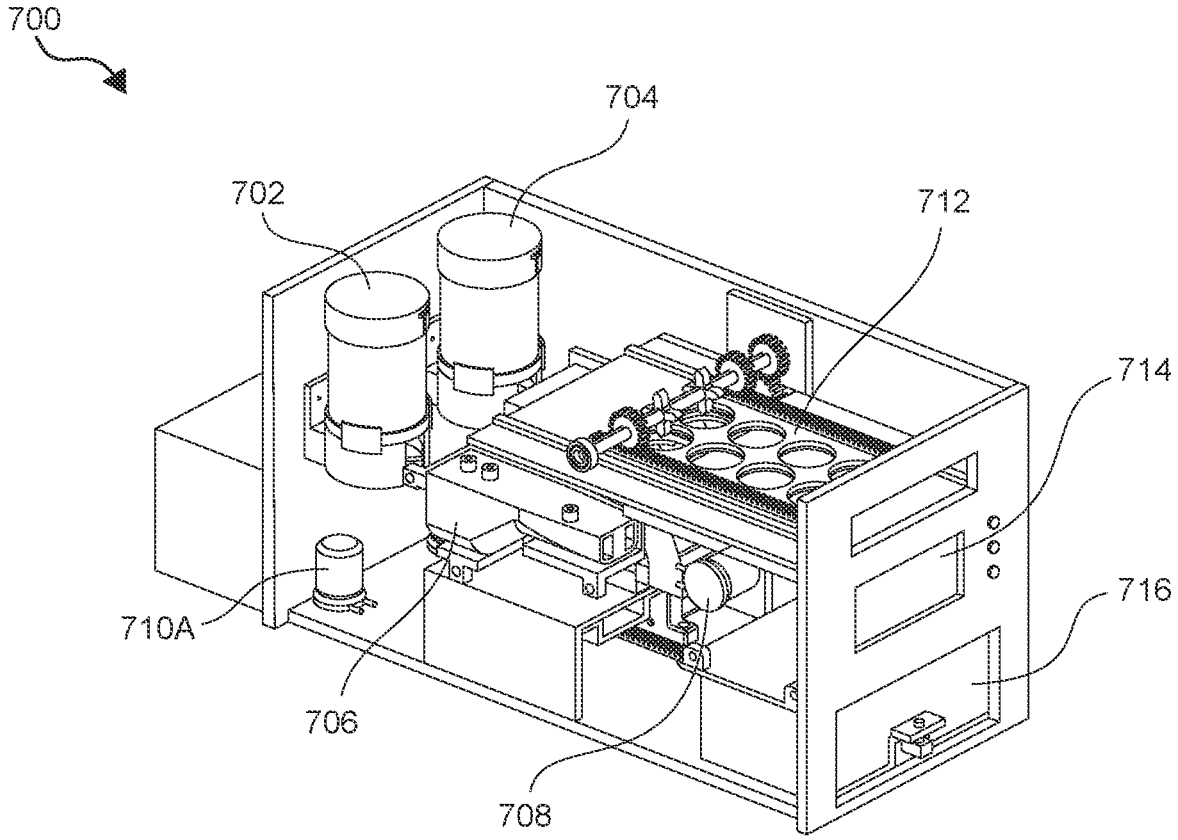
FIG. 7 is a top-left view of a second exemplary embodiment of the dispenser showing the internal components of the dispenser.

FIG. 7 is a top-left view of a dispenser 700 showing the internal components of dispenser 700. In the depicted embodiment, dispenser 700 includes first reservoir 702, second reservoir 704, water reservoir 706, pump 708, first reservoir pump 710A, towelette release mechanism 712, user interface 714, and towelette dispensing mechanism 716.

First reservoir 702 can contain any one or more additives for incorporation into a dispensed solution.

In a preferred embodiment, first reservoir 702 is configured to store a liquid additive. For example, first reservoir 702 can be configured to store a bleach-based concentrate for dilution into a greater volume of liquid. Liquid additives can include any one or more constituent components in liquid form. In some embodiments, liquid additives can comprise a singular component. For example, a liquid additive can be 100% isopropyl alcohol. In other embodiments, liquid additives can be mixture of different liquid components. For example, the liquid additive can be a mixture of a fragrance oil, water, and isopropyl alcohol.

In another embodiment, first reservoir 702 is configured to store a non-liquid additive. For example, first reservoir 702 can be configured to store a powdered surfactant for dilution into a greater volume of liquid. Non-liquid additives can include any one or more constituent components in substantially non-liquid form (e.g., solid, powdered, etc.). In some embodiments, non-liquid additives can comprise a singular component. For example, a liquid additive can be 100% sodium lauryl ether sulfate. In other embodiments, non-liquid additives can be mixture of different non-liquid components. For example, the non-liquid additive can be a mixture of a fragrance oil and sodium lauryl ether sulfate.

The invention herein contemplates the use of any liquid additives, non-liquid additives, or a combination thereof for storage in first reservoir 702.

First reservoir 702 can be made of any one or more materials configured to store additives.

In one embodiment, first reservoir 702 can be made of one or more plastics. For example, first reservoir 702 can be made of plastic materials when configured to store bleach in order to avoid rusting issues associated with metals. Plastics can any synthetic or semi-synthetic material that use polymers as the main ingredient. For example, plastics can include, but are not limited to, polyethylene terephthalate ("PET"), high-density polyethylene ("HDPE"), polyvinyl chloride ("PVC"), polypropylene ("PP"), and low-density polyethylene ("LDPE").

In another embodiment, first reservoir 702 can be made of one or more metals. For example, first reservoir 702 can be made of a heat-resistant metal alloy to allow first reservoir 702 to be heated directly or come into contact with heated components. In another example, first reservoir 702 can be made of stainless steel for sterility and cleaning purposes.

In another embodiment, first reservoir 702 can be made of one or more non-resilient and/or non-ductile materials. For example, first reservoir 702 can be made of a ceramic material to allow first reservoir 702 to be heated directly or come into contact with heated components. In another example, first reservoir 702 can be made of a glass to allow a user to look into the reservoir and trouble shoot problems.

In some embodiments, first reservoir 702 can be removable. It is contemplated that reservoir 702 can be removably secured to the housing of dispenser 700 using any securement means. For example, securement means can include any one or more mechanisms including, for example, snap-fit mechanisms, hook and loop fasteners, screw-fit mechanisms, friction-fit mechanisms, and magnetic mechanisms.

Second reservoir 704 can also contain any one or more additives for incorporation into a dispensed solution.

In a preferred embodiment, second reservoir 704 is configured to store a liquid additive. For example, second reservoir 704 can be configured to store a bleach-based concentrate for dilution into a greater volume of liquid. Liquid additives can include any one or more constituent components in liquid form. In some embodiments, liquid additives can substantially comprise a singular component. For example, a liquid additive can be 100% hydrogen peroxide. In other embodiments, liquid additives can be mixture of different liquid components. For example, the liquid additive can be a mixture of a fragrance oil, water, and benzalkonium chloride.

In another embodiment, second reservoir 704 is configured to store a non-liquid additive. For example, second reservoir 704 can be configured to store a powdered surfactant for dilution into a greater volume of liquid. Non-liquid additives can include any one or more constituent components in substantially non-liquid form (e.g., solid, powdered, etc.). In some embodiments, non-liquid additives can comprise a singular component. For example, a liquid additive can be 100% sodium lauryl ether sulfate. In other embodiments, non-liquid additives can be mixture of different non-liquid components. For example, the non-liquid additive can be a mixture of a fragrance oil and sodium lauryl ether sulfate.

The invention herein contemplates the use of any liquid additives, non-liquid additives, or a combination thereof for storage in first reservoir 702.

Second reservoir 704 can be made of any one or more materials configured to store additives.

In one embodiment, second reservoir 704 can be made of one or more plastics. For example, second reservoir 704 can be made of plastic materials when configured to store bleach in order to avoid rusting issues associated with metals. Plastics can any synthetic or semi-synthetic material that use polymers as the main ingredient. For example, plastics can include, but are not limited to, polyethylene terephthalate ("PET"), high-density polyethylene ("HDPE"), polyvinyl chloride ("PVC"), polypropylene ("PP"), and low-density polyethylene ("LDPE").

In another embodiment, second reservoir 704 can be made of one or more metals. For example, second reservoir 704 can be made of a heat-resistant metal alloy to allow second reservoir 704 to be heated directly or come into contact with heated components. In another example, second reservoir 704 can be made of stainless steel for sterility and cleaning purposes.

In another embodiment, second reservoir 704 can be made of one or more non-resilient and/or non-ductile materials. For example, second reservoir 704 can be made of a ceramic material to allow second reservoir 704 to be heated directly or come into contact with heated components. In another example, second reservoir 704 can be made of a glass to allow a user to look into the reservoir and trouble shoot problems.

In some embodiments, second reservoir 704 can be removable. It is contemplated that second reservoir 704 can be removably secured to the housing of dispenser 700 using any securement means. For example, securement means can include any one or more mechanisms including, for example, snap-fit mechanisms, hook and loop fasteners, screw-fit mechanisms, friction-fit mechanisms, and magnetic mechanisms.

As used herein, reservoirs may have user-accessible ports. User-accessible ports can include removable lids, such as friction-fit lids, screw top lids, magnetic lids, and any other barrier that can be removed to allow a user to access the inner lumen of a reservoir.

Water reservoir 706 is configured to store water. In a preferred embodiment, water reservoir 706 includes a heating element configured to control the temperature of the water stored therein. For example, water reservoir 706 can be coupled to an electric heater coil, a temperature sensor, and a processor to keep the temperature of the water stored inside at a predetermined temperature. In another example, water reservoir 706 can be coupled to an electric heater coil, a temperature sensor, and a processor and configured to dynamically change the temperature of the water inside water reservoir according to one or more program instructions. In yet another example, water reservoir 706 can be configured to send unheated water through a heating element, such as a heat exchanger, to isolate the heating element from water reservoir 706.

Pump 708 can include any one or more components configured to push a resulting liquid solution out to one or more towelettes. In one example, pump 708 can be an air pump. In another example, pump 708 can be a hydrostatic pump.

However, it is contemplated that any commercially available pump can be used. For example, pump 708 can be selected from one or more of a plunger-based pump, a piston-based pump, a circumferential-piston pump, a diaphragm pump, a bellows pump, gear pumps, lobed pumps, flexible-vane pumps, nutating pumps, peristaltic pumps, centrifugal pumps, and mixed-flow pumps.

First reservoir pump 710A can include any one or more components configured to push an additive contained in reservoir 702 out of reservoir 702 for inclusion in a dispensed solution. For example, first reservoir pump 710A can be a peristaltic pump. In another example, pump 708 can be a hydrostatic pump.

However, it is contemplated that any commercially available pump can be used. For example, first reservoir pump 710A can be selected from one or more of a plunger-based pump, a piston-based pump, a circumferential-piston pump, a diaphragm pump, a bellows pump, gear pumps, lobed pumps, flexible-vane pumps, nutating pumps, peristaltic pumps, centrifugal pumps, and mixed-flow pumps.

Towelette release mechanism 712 is configured to release towelettes from towelette cartridges, which will be discussed in further detail below.

User interface 714 provides an interface to a user to allow information to be displayed and/or program instructions to be received from a user. User interface 714 can include any one or more of graphical elements, tactile elements, and auditory elements configured to send information to a user and receive information from a user. For example, user interface 714 can include a capacitive touch screen for displaying information and receiving input from a user, a physical power switch, and a speaker configured to play auditory notifications.

Towelette dispensing mechanism 716 can be any combination of component configured to extend and retract dispensing tray 1506 (discussed in further detail below). Towelette dispensing mechanism 716 can include a retractable slide that can be extended out of the device when the moistened towelettes are ready to use (fully expanded and wet). It is also contemplated that towelette dispensing mechanism 716 can be automatically retracted into the device for next service after the moistened towelette is picked up.

Alternatively, towelette dispensing mechanism 716 can be automatically retracted after a predetermined time (e.g., 30 seconds, 60 seconds, etc.) after towelette dispensing mechanism 716 is exposed out of the device. In other embodiments, towelette dispensing mechanism 716 can be manually pushed into the device by the user.

It is also contemplated that towelette dispensing mechanism 716 can be coupled to one or more sensors that allow dispenser 100 to detect that towelette dispensing mechanism 716 either contains or does not contain a moistened towelette. For example, dispenser 700 may contain a weight sensor that detects when the moistened towelette has been lifted out of towelette dispensing mechanism 716 by a user. In another example, dispenser 100 may contain a light sensor that detects when towelette dispensing mechanism 716 opens to the outside environment and causes towelette dispensing mechanism 716 to retract after a set period of time.

Figure 8:
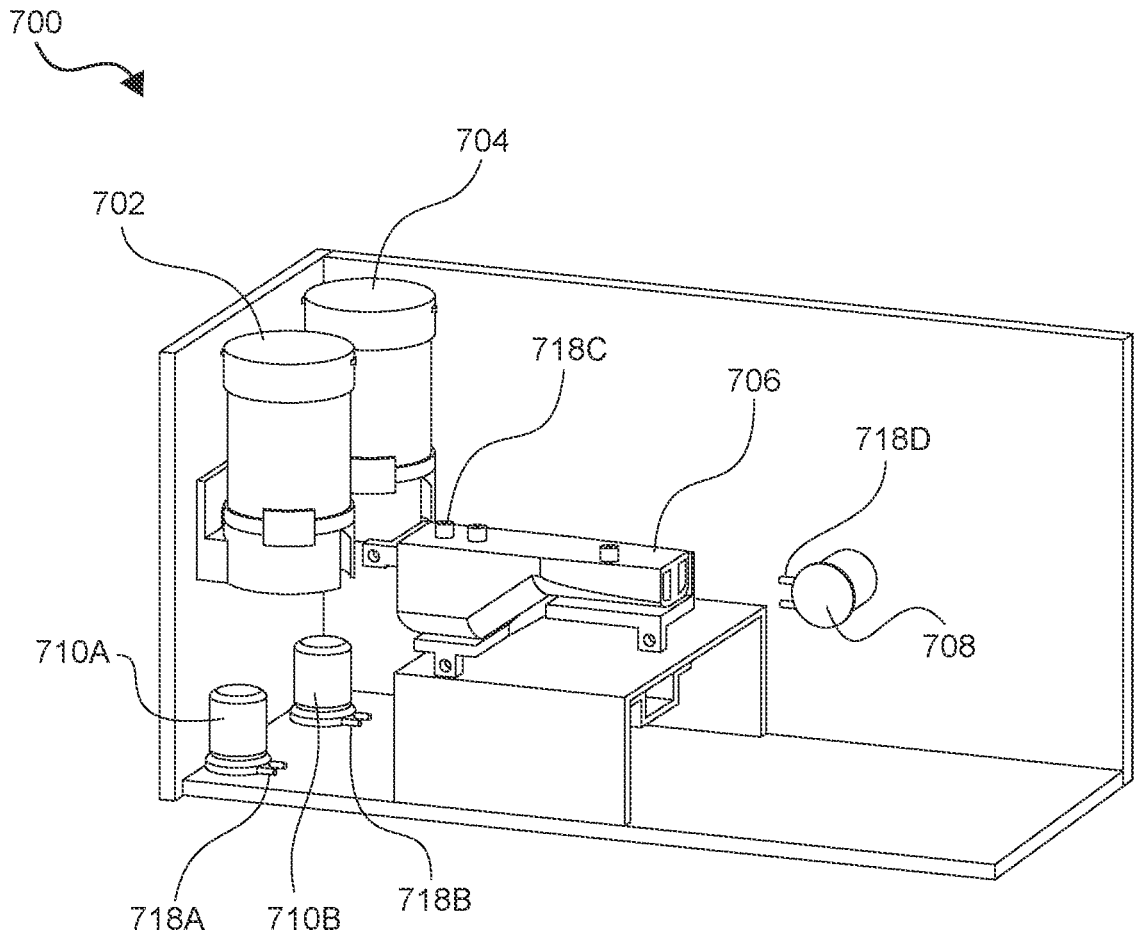
FIG. 8 is top-left view of the second exemplary embodiment of the dispenser with the towelette releasing mechanism removed.

FIG. 8 is top-left view of the second exemplary embodiment of dispenser 700 with the towelette releasing mechanism removed. FIG. 8 further depicts reservoir pump 710B, first reservoir pump I/O 718A, second reservoir pump I/O 718B, water reservoir I/O 718C, and pump I/O 718D.

Second reservoir pump 710B can include any one or more components configured to push an additive contained in reservoir 704 out of reservoir 704 for inclusion in a dispensed solution. For example, second reservoir pump 710B can be a peristaltic pump. In another example, pump 708 can be a hydrostatic pump.

However, it is contemplated that any commercially available pump can be used. For example, second reservoir pump 710B can be selected from one or more of a plunger-based pump, a piston-based pump, a circumferential-piston pump, a diaphragm pump, a bellows pump, gear pumps, lobed pumps, flexible-vane pumps, nutating pumps, peristaltic pumps, centrifugal pumps, and mixed-flow pumps.

First reservoir pump I/O 718A can include any one or more elements enabling operation of first reservoir pump 710A.

In one embodiment, first reservoir pump I/O 718A is an interface enabling reservoir pump 710A to transmit and receive electricity. For example, first reservoir pump I/O 718A can be an input/output interface configured to receive electricity from a power source. In another example, first reservoir pump I/O 718A can include an input/output interface configured to couple transmit and receive electrical signals via one or more wired signal transmission mediums.

In another embodiment, first reservoir pump I/O 718A is coupled to wireless communication elements. For example, first reservoir pump I/O 718A can include a near field communications elements, such as wireless fidelity and/or Bluetooth® technologies. The wireless communication elements can facilitate the transmission of program instructions to enable wireless functionality, such as internet-of-things (IoT) functionality.

In another example, the wireless communication elements can be based on light. For example, an infrared transmitter can be used to communicate program instructions to a receive and controller coupled to first reservoir pump I/O 718A. In yet another example, the wireless communication elements can be based on sound. For example, an ultrasonic frequency can be used to communicate program instructions to a microphone and controller coupled to first reservoir pump I/O 718A.

In another embodiment, first reservoir pump I/O 718A is an interface enabling reservoir pump 710A to transmit and receive liquid and/or non-liquid additives. For example, first reservoir pump I/O 718A can be an input/output interface configured to receive a first liquid additive from first reservoir 702 and pump out a predetermined amount of the first liquid additive for inclusion in a dispensed solution.

It is contemplated that any transmission mediums can be used to for input/output elements associated with the invention herein. In a fluid-based example, transmission mediums can include plastic, rubber, and/or metal tubes for delivering liquids in fluid-based applications.

In an electricity-based example, transmission mediums can include one or more wired connections coupling electronic mechanisms and enabling the delivery of electricity and data signals. Dispenser 700 may be coupled to and/or include one or more processors to manage the transmission of program instructions between coupled electronic components, such as the delivery of user input commands from user interface 714.

Second reservoir pump I/O 718B can include any one or more elements enabling operation of second reservoir pump 710B. In one embodiment, second reservoir pump I/O 718B is an interface enabling second reservoir pump 710B to transmit and receive electricity. For example, second reservoir pump I/O 718B can be an input/output interface configured to receive electricity from a power source. In another example, second reservoir pump I/O 718B can include an input/output interface configured to couple transmit and receive electrical signals via one or more wired signal transmission mediums.

In another embodiment, second reservoir pump I/O 718B is coupled to wireless communication elements. For example, second reservoir pump I/O 718B can include a near field communications elements, such as wireless fidelity and/or Bluetooth® technologies. The wireless communication elements can facilitate the transmission of program instructions to enable wireless functionality, such as internet-of-things (IoT) functionality.

In another example, the wireless communication elements can be based on light. For example, an infrared transmitter can be used to communicate program instructions to a receive and controller coupled to second reservoir pump I/O 718B. In yet another example, the wireless communication elements can be based on sound. For example, an ultrasonic frequency can be used to communicate program instructions to a microphone and controller coupled to second reservoir pump I/O 718B.

In another embodiment, second reservoir pump I/O 718B is an interface enabling reservoir pump 710A to transmit and receive liquid and/or non-liquid additives. For example, second reservoir pump I/O 718B can be an input/output interface configured to receive a first liquid additive from second reservoir 704 and pump out a predetermined amount of the first liquid additive for inclusion in a dispensed solution.

It is contemplated that any transmission mediums can be used to for input/output elements associated with the invention herein. In a fluid-based example, transmission mediums can include plastic, rubber, and/or metal tubes for delivering liquids in fluid-based applications.

In an electricity-based example, transmission mediums can include one or more wired connections coupling electronic mechanisms and enabling the delivery of electricity and data signals. Dispenser 700 may be coupled to and/or include one or more processors to manage the transmission of program instructions between coupled electronic components, such as the delivery of user input commands from user interface 714.

Water reservoir I/O 718C can include any one or more elements that enable the operation of water reservoir 706. In one embodiment, water reservoir I/O 718C includes an input/output interface configured to receive electricity from a power source. In another example, water reservoir I/O 718C can include an input/output interface configured to couple transmit and receive electrical signals via one or more wired signal transmission mediums.

In another embodiment, water reservoir I/O 718C is coupled to wireless communication elements. For example, water reservoir I/O 718C can include a near field communications elements, such as wireless fidelity and/or Bluetooth® technologies. The wireless communication elements can facilitate the transmission of program instructions to enable wireless functionality, such as internet-of-things (IoT) functionality.

In another example, the wireless communication elements can be based on light. For example, an infrared transmitter can be used to communicate program instructions to a receive and controller coupled to water reservoir 706. In yet another example, the wireless communication elements can be based on sound. For example, an ultrasonic frequency can be used to communicate program instructions to a microphone and controller coupled to water reservoir 706.

In another embodiment, water reservoir I/O 718C is an interface enabling reservoir pump 710A to transmit and receive liquid and/or non-liquid additives. For example, water reservoir I/O 718C can be an input/output interface configured to receive liquid additives from first reservoir 702 and second reservoir 704 for dilution with water.

It is contemplated that any transmission mediums can be used to for input/output elements associated with the invention herein. In a fluid-based example, transmission mediums can include plastic, rubber, and/or metal tubes for delivering liquids in fluid-based applications.

In an electricity-based example, transmission mediums can include one or more wired connections coupling electronic mechanisms and enabling the delivery of electricity and data signals. Dispenser 700 may be coupled to and/or include one or more processors to manage the transmission of program instructions between coupled electronic components, such as the delivery of user input commands from user interface 714.

Pump I/O 718D can include any one or more elements that enable the operation of water reservoir 706. In one embodiment, pump I/O 718D includes an input/output interface configured to receive electricity from a power source. In another example, pump I/O 718D can include an input/output interface configured to couple transmit and receive electrical signals via one or more wired signal transmission mediums.

In another embodiment, pump I/O 718D is coupled to wireless communication elements. For example, pump I/O 718D can include a near field communications elements, such as wireless fidelity and/or Bluetooth® technologies. The wireless communication elements can facilitate the transmission of program instructions to enable wireless functionality, such as internet-of-things (IoT) functionality.

In another example, the wireless communication elements can be based on light. For example, an infrared transmitter can be used to communicate program instructions to a receive and controller coupled to water reservoir 706. In yet another example, the wireless communication elements can be based on sound. For example, an ultrasonic frequency can be used to communicate program instructions to a microphone and controller coupled to pump 708.

In another embodiment, pump I/O 718D is an interface enabling reservoir pump 710A cause a solution to be expelled onto towelettes for absorption. In one example, pump I/O 718D can be an input/output interface configured to receive air from an air pump, which can enable pump 708 to use positive air pressure to expel a mixture of additives from first reservoir 702, second reservoir 704, and water reservoir 706.

It is contemplated that any transmission mediums can be used to for input/output elements associated with the invention herein. In a fluid-based example, transmission mediums can include plastic, rubber, and/or metal tubes for delivering liquids in fluid-based applications. In a gas-based example, transmission mediums can include plastic, rubber, and/or metal tubes for delivering liquids in fluid-based applications.

In an electricity-based example, transmission mediums can include one or more wired connections coupling electronic mechanisms and enabling the delivery of electricity and data signals. Dispenser 700 may be coupled to and/or include one or more processors to manage the transmission of program instructions between coupled electronic components, such as the delivery of user input commands from user interface 714.

Figure 9:
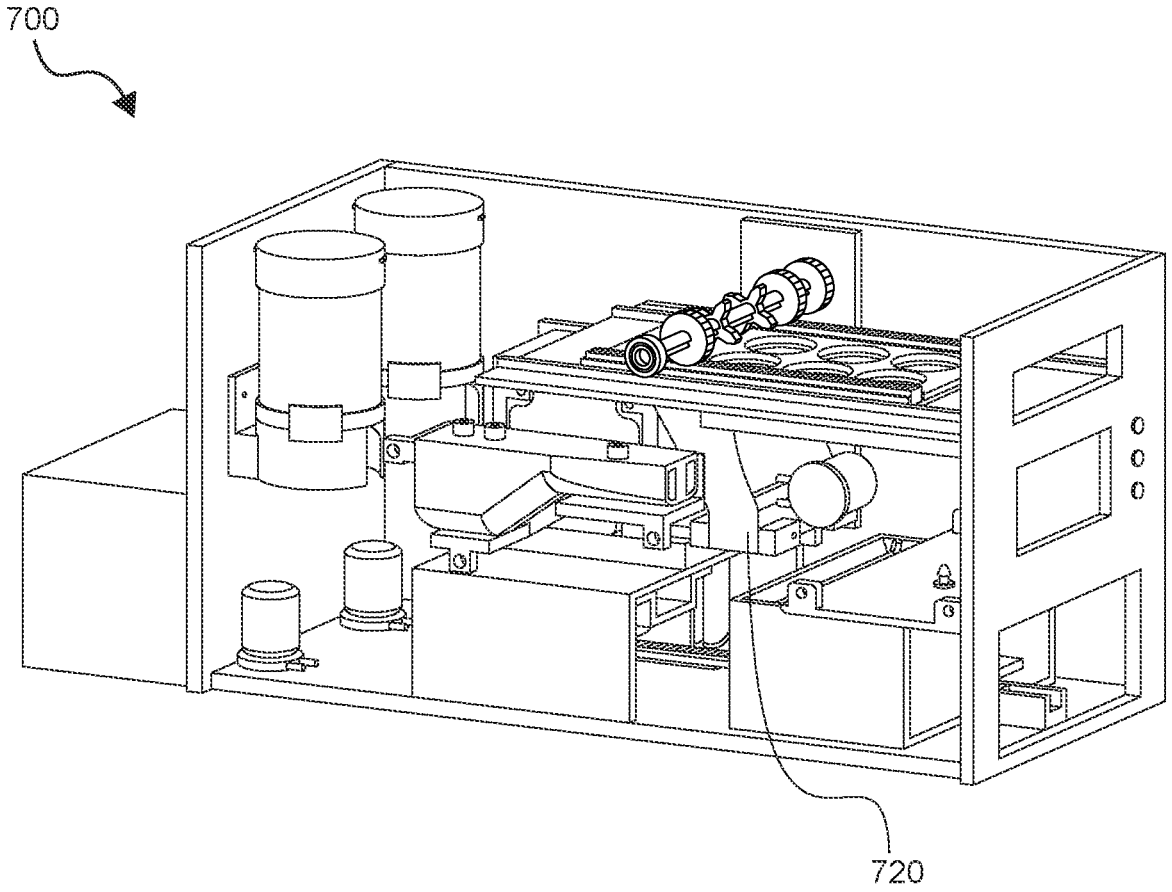
FIG. 9 is a perspective view of the towelette chute mechanism including the towelette chute and associated sensor.

FIG. 9 is a perspective view of towelette chute mechanism 720 for delivering released towelettes from towelette dispensing mechanism 716, which will be discussed in further detail below.

Figure 10:
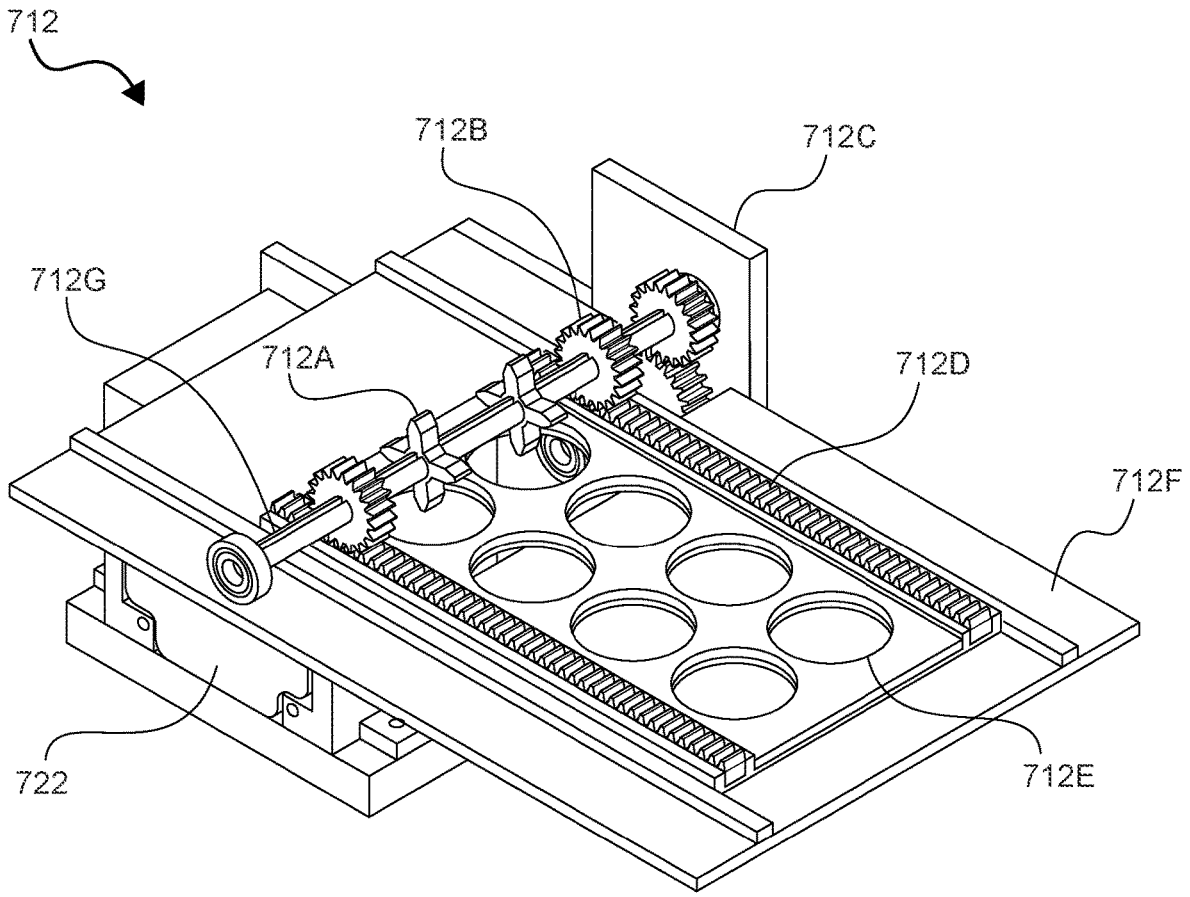
FIG. 10 is a perspective view of a towelette release mechanism.

FIG. 10 is a perspective view of towelette release mechanism 712. In the depicted embodiment, towelette release mechanism 712 includes upper gear 712A, spur gear 712B, gear mount 712C, spur rack 712D, blister cartridge tray 712E, platform 712F, axle 712G, and gear box 722.

Upper gear 712A can use mechanical pressure to cause a towelette to be ejected from a blister pack cartridge. In the depicted embodiment, upper gear 712A is substantially fixed and rotates about axle 712G. The rotation of upper gear 712A about axle 712G is rotationally coupled to spur gear 712B by virtue of being substantially fixed to axle 712G. As gear box 722 is driven by a motor, such as an electric motor, to rotate, the resulting rotational energy is contemplated to cause rotation of spur gear 712B, which, in turn, causes blister cartridge tray 712E to translate along the surface of platform 712F. In doing so, upper gear 712A is contemplated to put pressure on a blister pack sufficient to release a sealed towelette using one or more of the protrusions associated with upper gear 712A, while simultaneously moving the next two sealed towelettes in position for later release.

Spur gear 712B is contemplated to include any one or more physical features that allow spur gear 712B to removably couple with spur rack 712D. Spur rack 712D is contemplated to include any one or more physical features that allow spur rack 712D to removably couple with spur gear 712B. The physical features may include, but are not limited to, magnetic features, gear teeth, and friction-based features (e.g., use of resilient material to substantially anchor blister cartridge tray 712E).

The depicted embodiment illustrates a blister cartridge tray configured to hold an eight blister towelette cartridge. However, it is contemplated that blister cartridge tray can be configured to accommodate alternative cartridge types and shapes.

Figure 11:
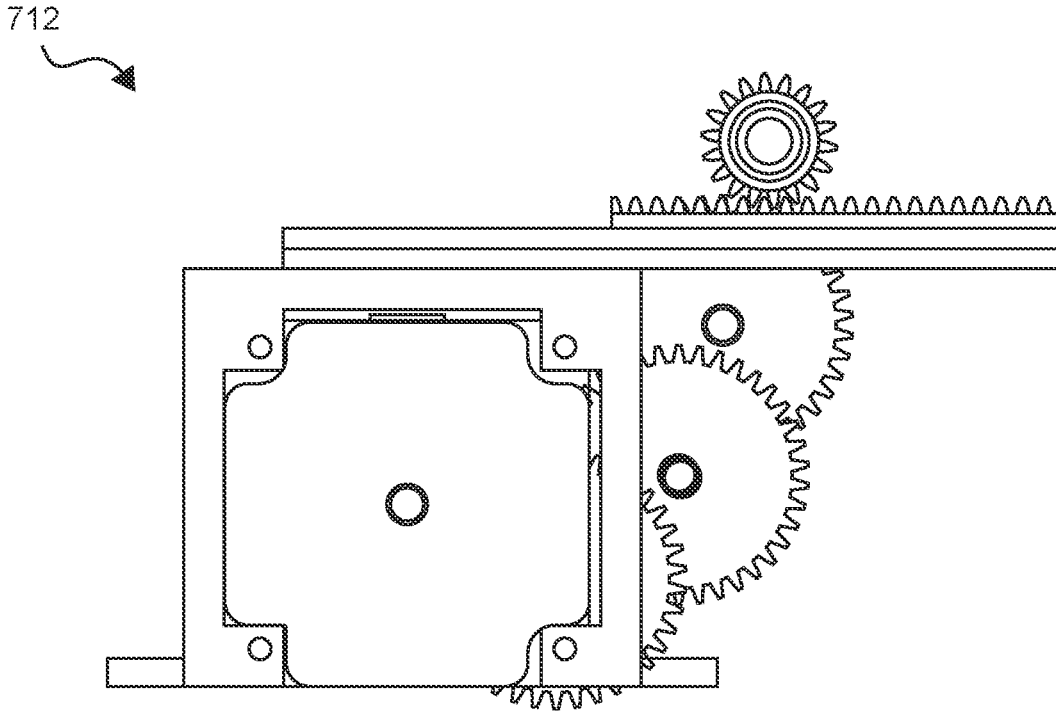
FIG. 11 is a left-side view of towelette release mechanism configured to cause an ejection mechanism to release a towelette from a cartridge.

FIG. 11 is a left-side view of towelette release mechanism 712 configured to cause an ejection mechanism to release a towelette from a cartridge.

Figure 12:
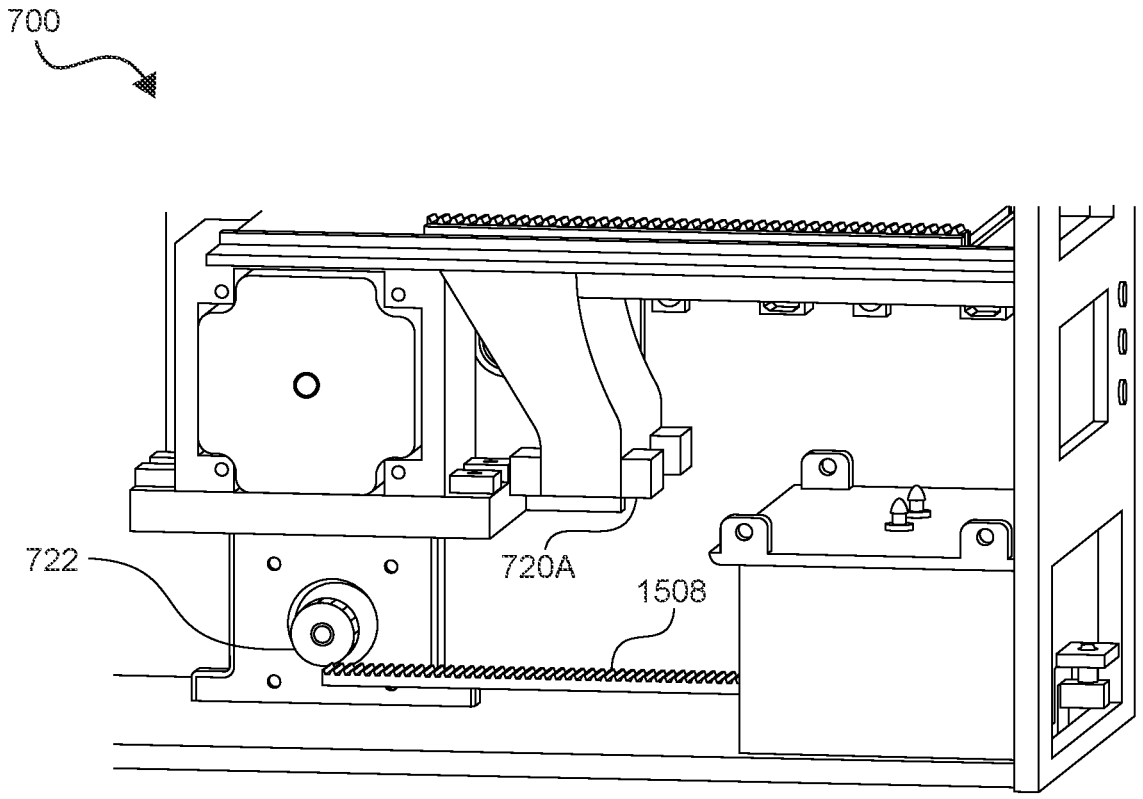
FIG. 12 is a left-side view of a towelette chute mechanism with the reservoir, pump, and other structural components removed.

FIG. 12 is a left-side view of towelette chute mechanism 720 with the reservoir, pump, and other structural components removed. As depicted, towelette chute mechanism 720 includes sensor housing 720A, tray spur gear 722, and tray spur rack 1508. Tray spur gear 722 is contemplated to be connected to a motor. When the motor is activated, tray spur gear 722 is configured to rotate. The rotational energy is transferred to tray spur rack 1508, which causes translational movement of the tray spur rack 1508. Tray spur rack 1508 is contemplated to be physically coupled to tray 1506 of towelette dispensing mechanism 716, which will be discussed in further detail below.

As used herein, a motor can include any means of transducing inputted energy to physical work. For example, motors may be adapted to accept any input, such as electricity, combustive materials, and pressurized gases.

Figure 13:
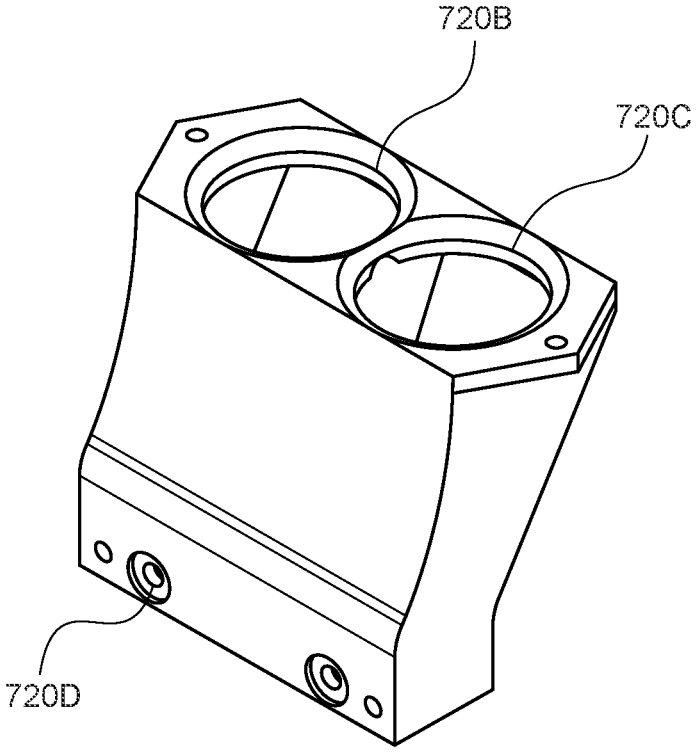
FIG. 13 is a perspective view of the towelette chute.

FIG. 13 is a perspective view of towelette chute mechanism 720, which includes chute 720B and chute 720C. Chute mechanism 720 is not limited to having chute 720B and chute 720C as depicted herein. Chute mechanism 720 may include any combination of chutes in one or more physical configurations.

Towelette chute mechanism 720 is depicted to further include sensor housing 720A. Sensor housing 720A can include any one or more sensors configured to detect a successful passage of a towelette through a chute. For example, sensor housing 720A can house an optical sensor system that detects when an object breaks a light path.

Figure 14:
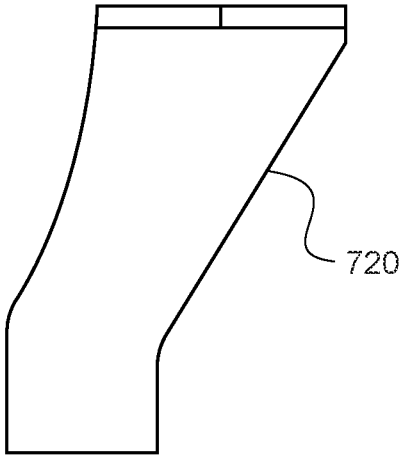
FIG. 14 is a right-side view of the towelette chute.

FIG. 14 is a right-side view of towelette chute mechanism 720.

Figure 15A:
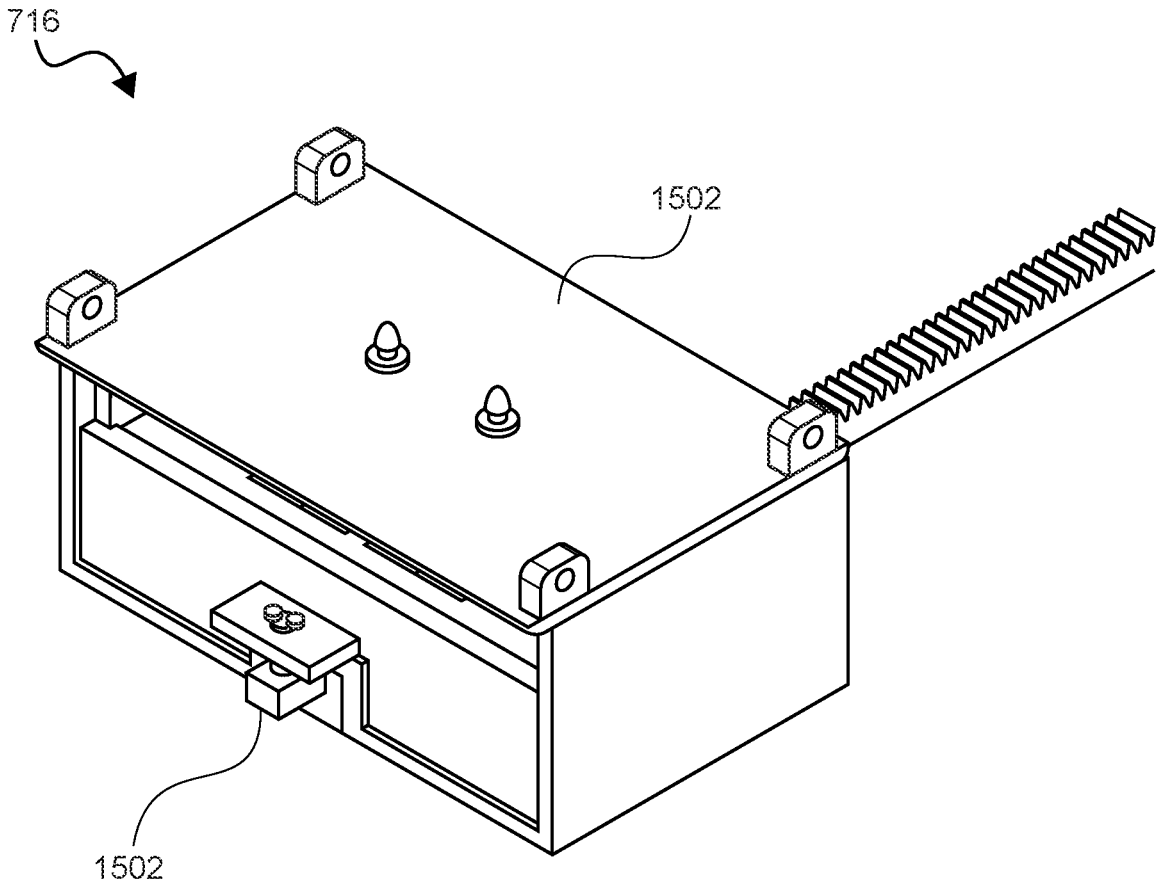
FIG. 15A is a perspective view of the towelette dispensing mechanism.

FIG. 15A is a perspective view of towelette dispensing mechanism 716. As depicted, towelette dispensing mechanism 716 includes tray housing 1502 and tray pin lock 1504. However, the depicted embodiment is illustrative and may include additional or fewer features depending on the application. For example, tray pin lock 1504 may not be present in an embodiment that uses a magnetic connection to substantially couple the movement of tray 1506 with the translative movement of 1508 in response to the turning of tray spur gear 722.

Figure 15B:
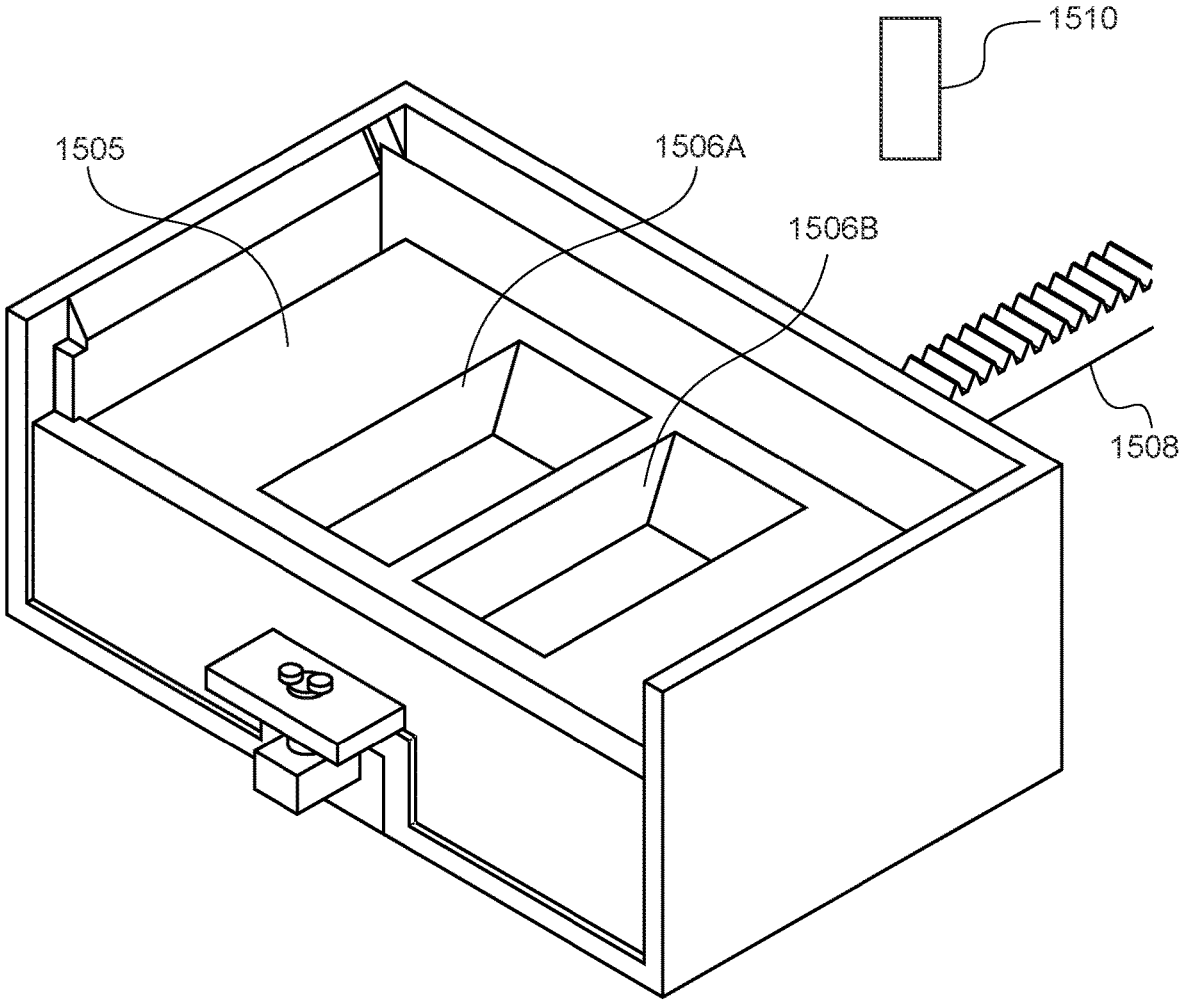
FIG. 15B is a perspective view of the towelette dispensing mechanism with the towelette tray cover removed and the towelette tray exposed.

FIG. 15B is a perspective view of towelette dispensing mechanism 716 with the towelette tray cover removed and the towelette tray 1505 exposed. As depicted, towelette dispensing mechanism 716 further includes first tray slot 1506A and second tray slot 1506B, which are adapted to receive released towelettes. Fluid release port 1510 is fluidly directly and/or indirectly coupled to first reservoir 702, second reservoir 704, and water reservoir 706. In a preferred embodiment, fluid release port 1510 is coupled to pump 708. Actuation of pump 708 is contemplated to cause the release of a liquid solution including one or more additives to one or more towelettes for absorption.

In some embodiments, the numbers expressing quantities or ranges, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified, thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An adaptive towelette dispensing device, the device comprising:

a towelette releasing mechanism, wherein the towelette releasing mechanism further comprises:

a gearbox configured to transfer angular kinetic energy;

a tray platform;

a blister cartridge tray configured to receive at least two blister packs and wherein each of the at least two blister packs is dimensioned to contain a towelette, wherein the blister cartridge tray is mechanically coupled to the tray platform;

a gear spur rack, wherein the gear spur rack includes one or more gear spur rack teeth;

a spur gear, wherein the spur gear is shaped and dimensioned to removably and mechanically couple to the gear spur rack, and wherein the rotation of the spur gear causes movement of the blister cartridge tray;

at least two upper gears, wherein the upper gears are configured to apply mechanical pressure on each of the at least two blister packs such that the at least two blister packs are opened concurrently;

a first towelette chute and a second towelette chute, wherein each of the first and second towelette chutes is configured to receive a respective released towelette from the at least two blister packs and physically direct the released towelettes, and wherein each of the first and second towelette chutes are operatively coupled to one or more sensors; and a towelette dispensing mechanism, the towelette mechanism comprising:

a towelette tray includes a first tray slot cavity and a second tray slot cavity, each of the first and second tray slot cavities disposed to align with a respective towelette chute such that the towelettes are dispensed concurrently.

2. The device of claim 1, further comprising a sensor configured to detect at least one of a weight of dried compressed towelette, a number of dried compressed towelettes, and a moisture level of the dried compressed towelette.

3. The device of claim 1, wherein the towelette dispensing mechanism further comprises a dispensing tray configured to receive the released towelette, wherein the dispensing tray moves outwardly from a body of the device such that the released towelette can be picked up at the outside of the body of the device.

4. The device of claim 3, wherein the dispensing tray retracts once the released towelette is removed from the tray.

5. The device of claim 3, wherein the dispensing tray retracts into the body of the device after a predetermined time.

6. The device of claim 1, wherein the towelette chute comprises a first towelette chute and a second towelette chute, wherein each of the first and second towelette chutes is configured to receive a respective released towelette from the at least two blister cartridges and physically direct the released towelettes, and wherein each of the first and second towelette chutes are operatively coupled to the one or more sensors.

7. The device of claim 6, wherein the towelette tray further comprises a first tray slot cavity and a second tray slot cavity, wherein first tray slot cavity is disposed to align with the first towelette chute and the second tray slot cavity is disposed to align with the second towelette chute.

* * * * *